US005184764A

United States Patent [19]

Orovan et al.

[11] Patent Number: 5,184,764

[45] Date of Patent: Feb. 9, 1993

[54] LOAD SUPPORT

[76] Inventors: Ziv Orovan; Yitzchak Orovan, both of 23 Moshav Talmei Yehiel, Mobile Post North Lachish 79 810, Israel

[21] Appl. No.: 378,272

[22] Filed: Jul. 11, 1989

[30] Foreign Application Priority Data

Jul. 11, 1988 [IL] Israel ..... 87073

[51] Int. Cl.[5] ..... A45F 3/04

[52] U.S. Cl. ..... 224/215; 224/209; 224/211; 224/262

[58] Field of Search ..... 224/259, 261, 262, 263, 224/212, 211, 210, 209, 213, 215, 216

[56] References Cited

U.S. PATENT DOCUMENTS

| | | | |
|---|---|---|---|
| 1,981,076 | 11/1934 | Sells | 224/262 |
| 2,830,747 | 4/1958 | Creste | 224/150 |
| 2,925,205 | 2/1960 | Hunt | 224/262 |
| 3,033,431 | 5/1962 | Henderson et al. | 224/211 |
| 3,355,075 | 11/1967 | Dean | 224/262 |
| 4,168,793 | 9/1979 | Knight | 224/261 |
| 4,194,656 | 4/1988 | Zufich . | |
| 4,785,984 | 11/1988 | Seitz-Gangemi | 224/259 |

FOREIGN PATENT DOCUMENTS

| | | | |
|---|---|---|---|
| 8705375 | 5/1979 | Australia . | |
| 2183963 | 5/1973 | France . | |
| 58853 | 1/1938 | Norway | 224/210 |
| 764880 | 1/1957 | United Kingdom | 224/210 |
| 907687 | 6/1961 | United Kingdom . | |

*Primary Examiner*—Linda J. Sholl
*Attorney, Agent, or Firm*—Ladas & Parry

[57] ABSTRACT

A load support including a central body mounting assembly and a shoulder mounting assembly associated with the central body mounting assembly, the shoulder mounting assembly including first and second shoulder engagement elements which are arranged to be supported by first and second shoulders of a user, the first and second shoulder engagment elements being interconnected such that orientation of a first shoulder of the user higher than his second shoulder produces a corresponding orientation of the first and second shoulder engagement elements, thus maintaining a desired load distribution between the two shoulders independent of the relative orientation thereof.

6 Claims, 6 Drawing Sheets

LOAD SUPPORT

FIELD OF THE INVENTION

The present invention relates to load supports to be carried by persons, such as backpacks.

BACKGROUND OF THE INVENTION

Various types of backpacks are known in the art. Modern backpack designs distribute the load onto the hips and shoulders of the user. While such designs provide a distribution which is suitable when the user is stationary, they fail to effectively accommodate users in dynamic situations such as walking, climbing, and related activities, wherein the relative spatial orientation of the various parts of the user's body changes with movement. As a result, the load is disproportionately placed on one shoulder or the other often leading to fatigued muscles.

A further disadvantage of backpacks known in the art is that the physical distances between the hip and shoulder supports is fixed during use. As a result, raising of the shoulders, for example, causes disproportionate placement of the load onto the shoulders and additionally bending by the user is severely restricted.

SUMMARY OF THE INVENTION

The present invention seeks to provide a load support which overcomes the above-described limitations and provides a desired dynamic load distribution.

There is thus provided in accordance with an embodiment of the present invention a load support including a central body mounting assembly and a shoulder mounting assembly associated with the central body mounting assembly, the shoulder mounting assembly including first and second shoulder engagement elements which are arranged to be supported by first and second shoulders of a user, the first and second shoulder engagement elements being interconnected such that orientation of a first shoulder of the user higher than his second shoulder produces a corresponding orientation of the first and second shoulder engagement elements, thus maintaining a desired load distribution between the two shoulders independent of the relative orientation thereof.

There is also provided in accordance with an embodiment of the present invention a load support including a central body mounting assembly, a shoulder mounting assembly associated with the central body mounting assembly, and resilient apparatus for generally maintaining a desired distribution of a load on the load support between the central body mounting assembly and the shoulder mounting assembly notwithstanding changes in the relative orientations thereof.

There is additionally provided in accordance with a preferred embodiment of the present invention a load support including a central body mounting assembly, a shoulder mounting assembly associated with the central body mounting assembly, the shoulder mounting assembly including first and second shoulder engagement elements which are arranged to be supported by first and second shoulders of a user, and apparatus for connecting said central body mounting assembly to the shoulder mounting assembly which permits relative motion therebetween in three dimensions.

There is additionally provided in accordance with an embodiment of the present invention a load support including a central body mounting assembly, a shoulder mounting assembly associated with the central body mounting assembly, and apparatus for connecting said central body mounting assembly to the shoulder mounting assembly which permits relative motion therebetween in three dimensions, the first and second shoulder engagement elements being interconnected such that orientation of a first shoulder of the user higher than his second shoulder produces a corresponding orientation of the first and second shoulder engagement elements, thus maintaining a desired load distribution between the two shoulders independent of the relative orientation thereof.

There is further provided in accordance with a preferred embodiment of the present invention a load support including a central body mounting assembly, a shoulder mounting assembly associated with the central body mounting assembly, the shoulder mounting assembly including first and second shoulder engagement elements which are arranged to be supported by first and second shoulders of a user, and resilient apparatus for generally maintaining a desired distribution of a load on the load support between the central body mounting assembly and the shoulder mounting assembly notwithstanding changes in the relative orientations thereof, the first and second shoulder engagement elements being interconnected such that orientation of a first shoulder of the user higher than his second shoulder produces a corresponding orientation of the first and second shoulder engagement elements, thus maintaining a desired load distribution between the two shoulders independent of the relative orientation thereof.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
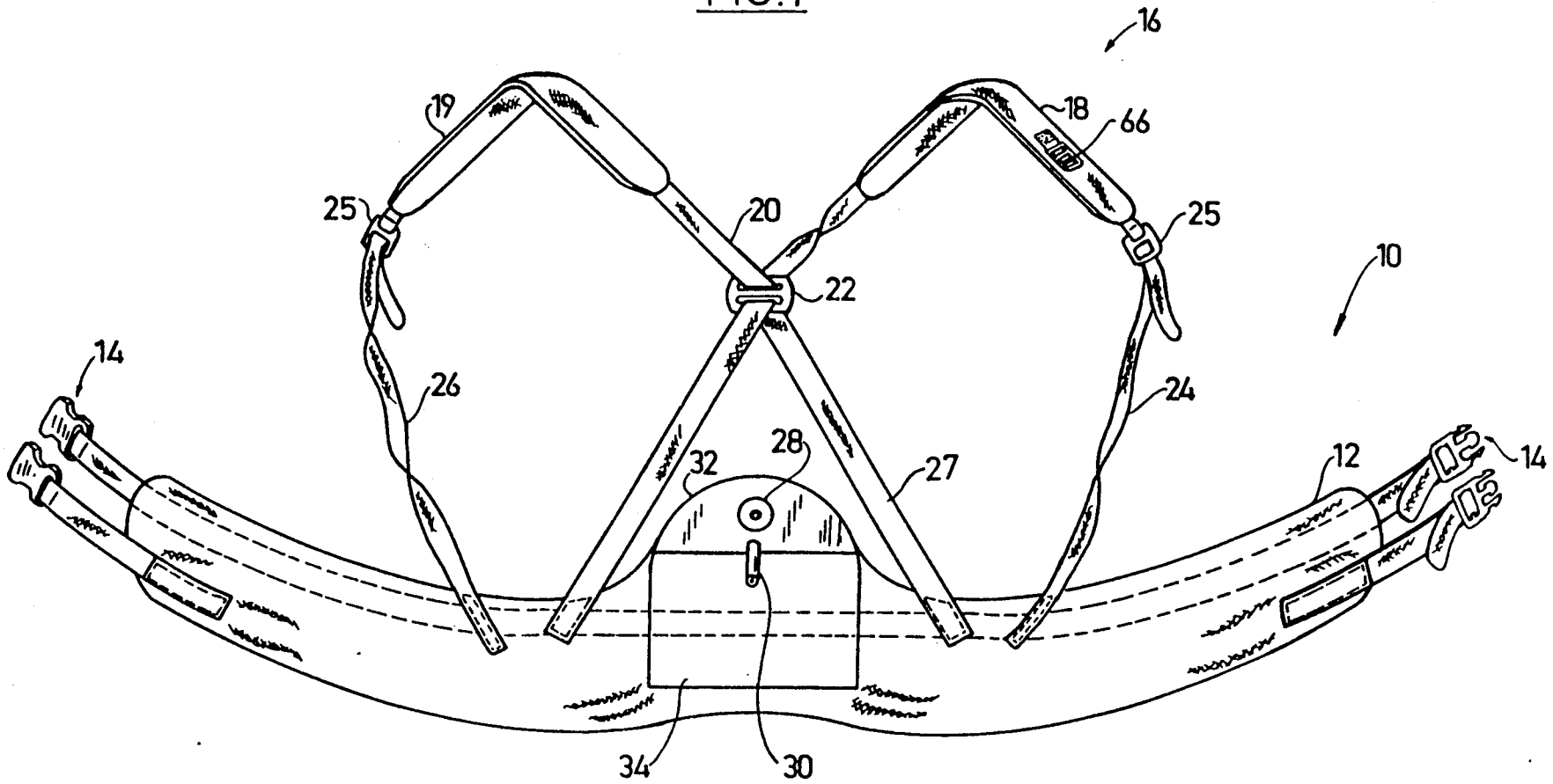
FIG. 1 is a pictorial illustration of a load support constructed and operative in accordance with a preferred embodiment of the present invention.
Figure 2B:
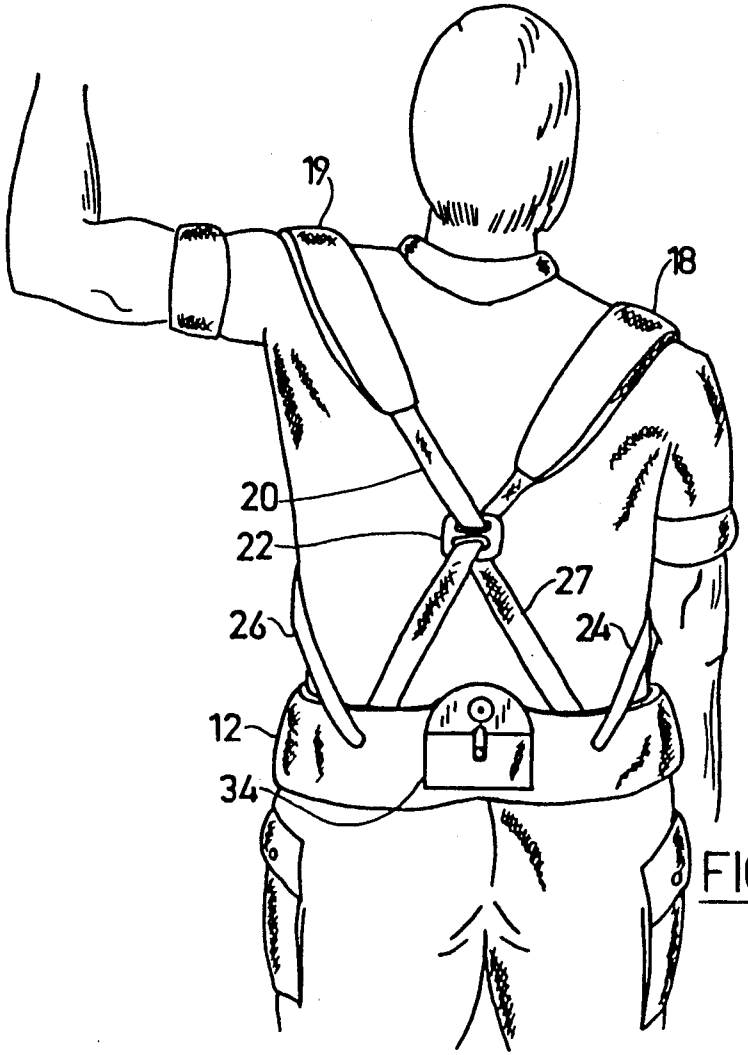
FIGS. 2A and 2B are pictorial illustrations of the load support of FIG. 1 in two different operative orientations.
Figure 2A:
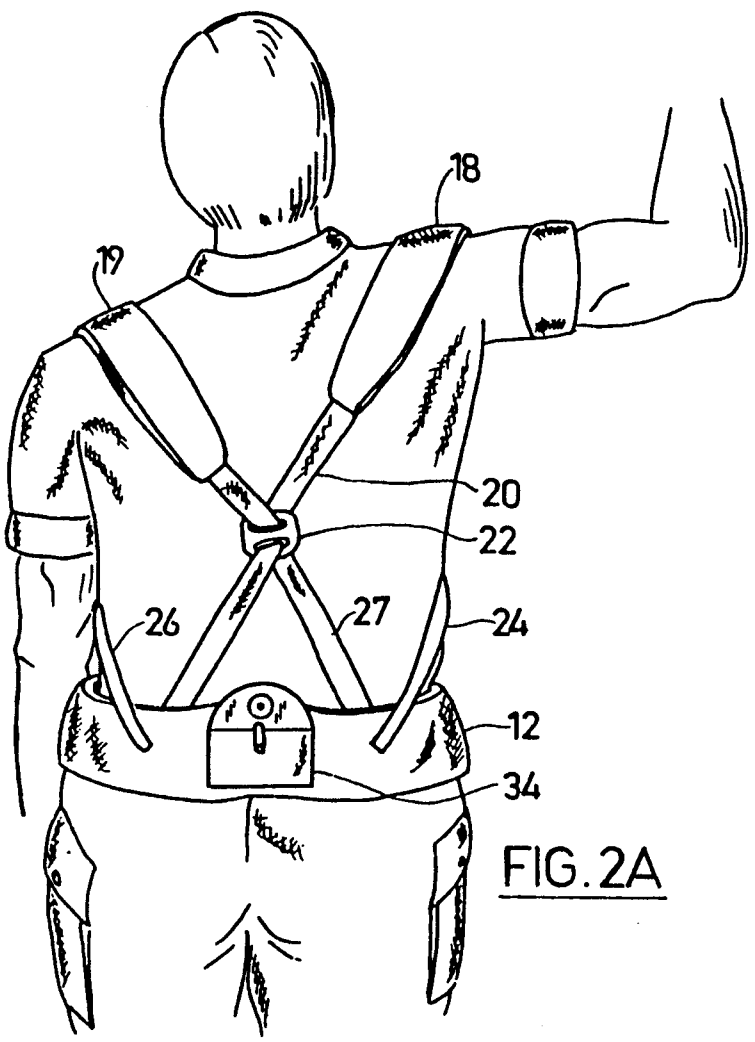

Reference is now made to FIG. 1 and FIGS. 2A and 2B which illustrate load support apparatus constructed and operative in accordance with a preferred embodiment of the present invention including a central body mounted portion 10, typically in the form of a hip belt 12, typically formed of flexible foamed plastic or any other material, which is provided with an adjustable clasp assembly 14. Hip belt 12 is designed to be supported on the user's hips and thus to transfer loads to the user's hips.

Associated with hip belt 12 is a shoulder support assembly 16 including a pair of shoulder pads 18 and 19, which in the preferred embodiment illustrated, are mounted on a single strap 20, which slidably extends through a buckle 22 at a location intermediate the two shoulder pads 18 and 19. The outwardly extending ends of strap 20, beyond each of shoulder pads 18, are coupled by adjustable buckles 25 to respective straps 24 and 26, which are fixedly attached, as by sewing, to hip belt 12. Buckle 22 is slidably mounted onto a strap 27, both of whose ends are fixedly attached, as by sewing to hip belt 12. Alternatively strap 27 may be configured as a single strap.

According to a preferred embodiment of the invention, one or all of straps 20, 24, 26 and 27 may be formed of a resilient material in order to permit stretching of the entire shoulder support assembly 16 so as to accommodate variations in the distance between the shoulders and the waist depending on the body orientation of the user.

Mounted onto hip belt 12 is a wire support roller 28 and a backpack spacer hook 30. Backpack spacer hook 30 is operative to maintain a desired spacing between the bottom rib 41 of backpack frame 40 (FIG. 4A) and the hip belt 12. The wire support roller 28 and backpack support hook 30 are typically mounted directly onto a metal plate 32 which is removably seated in a pocket 34 formed in hip belt 12.

It is a particular feature of the present invention that the shoulder support assembly 16 accommodates movement of the shoulders of the user relative to his hips which occurs during walking, climbing, and related activities. This feature may be appreciated by reference to FIGS. 2A and 2B. In FIG. 2A, the user's right shoulder is raised, and thus strap 20 slides with respect to buckle 22 such that shoulder pad 18 is raised with respect to hip belt 12 and shoulder pad 19 is correspondingly lowered. The opposite situation is illustrated in FIG. 2B, where the user's left shoulder is raised.

In the above situations, as well as when both shoulders are even with respect to each other, shoulder pads 18 and 19 automatically reorient themselves so as to distribute the load evenly on both shoulders, thereby lessening user fatigue.

Reference is now made to FIGS. 3A, 3B, 4A, 4B, 5A and 5B, which illustrate the backpack support apparatus constructed and operative in accordance with a preferred embodiment of the present invention. The backpack support apparatus is preferably based on and includes the load support apparatus of FIGS. 1, 2A and 2B in association with a backpack frame 40, typically formed of aluminum tube.

Figure 4B:
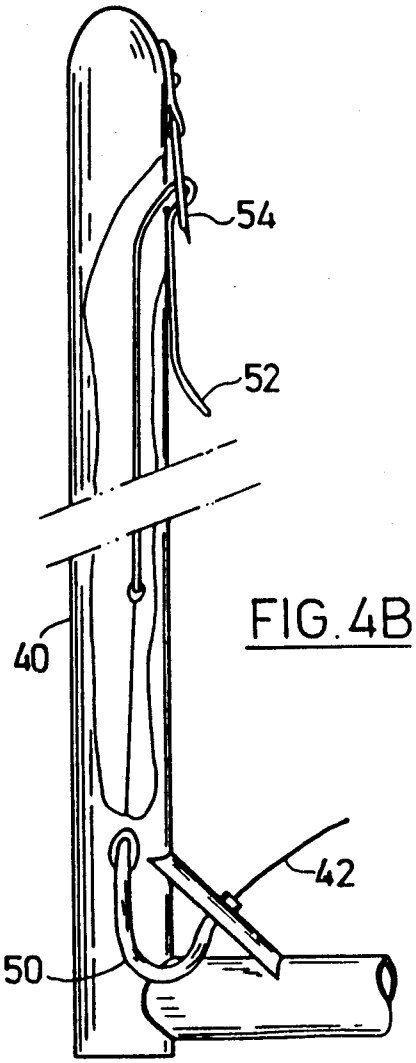
FIGS. 4A and 4B are respectively a pictorial view and a partially cut away side view illustration of the backpack support of FIGS. 3A and 3B.
Figure 4A:
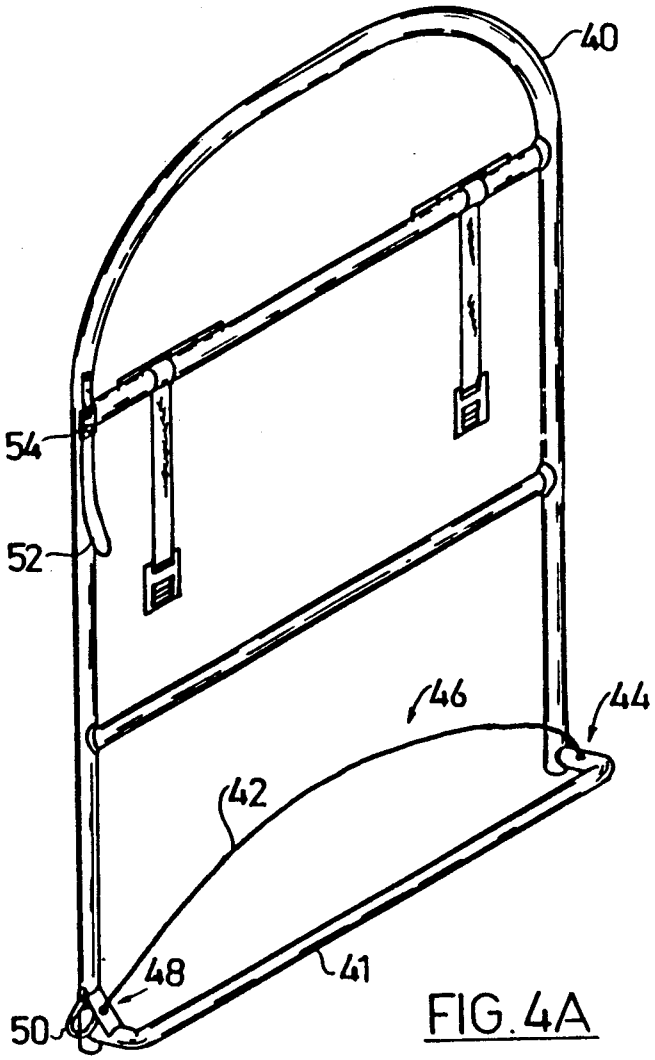

As seen with greater particularity in FIGS. 4A and 4B, a backpack support wire 42 extends from a fixed end mounted onto frame 40 at a location 44 in a loop 46 extending to a location 48 and thence through a concentric sleeve 50. The wire 42 terminates in an adjustment strap 52 which engages a buckle 54 and is selectably held thereby. Strap 52 may be formed of a resilient material or wire 42 may be formed of a somewhat resilient material for generally maintaining a desired distribution of a load on the load support between the central body mounting assembly and the shoulder mounting assembly notwithstanding changes in the relative orientations thereof.

Figure 3B:
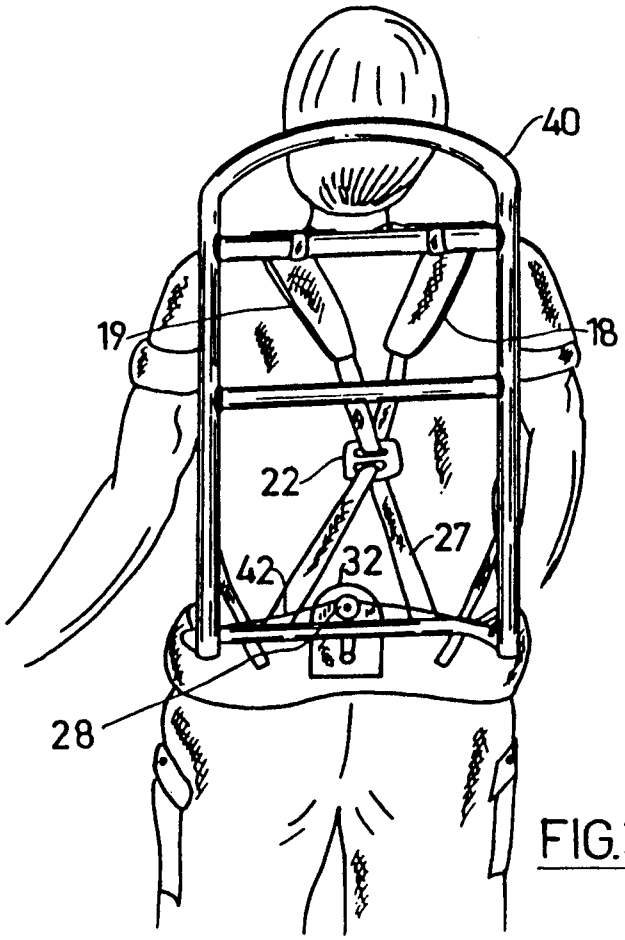
FIGS. 3A and 3B are two pictorial illustrations of a backpack support associated with the load support of FIG. 1 in two operative orientations.
Figure 3A:
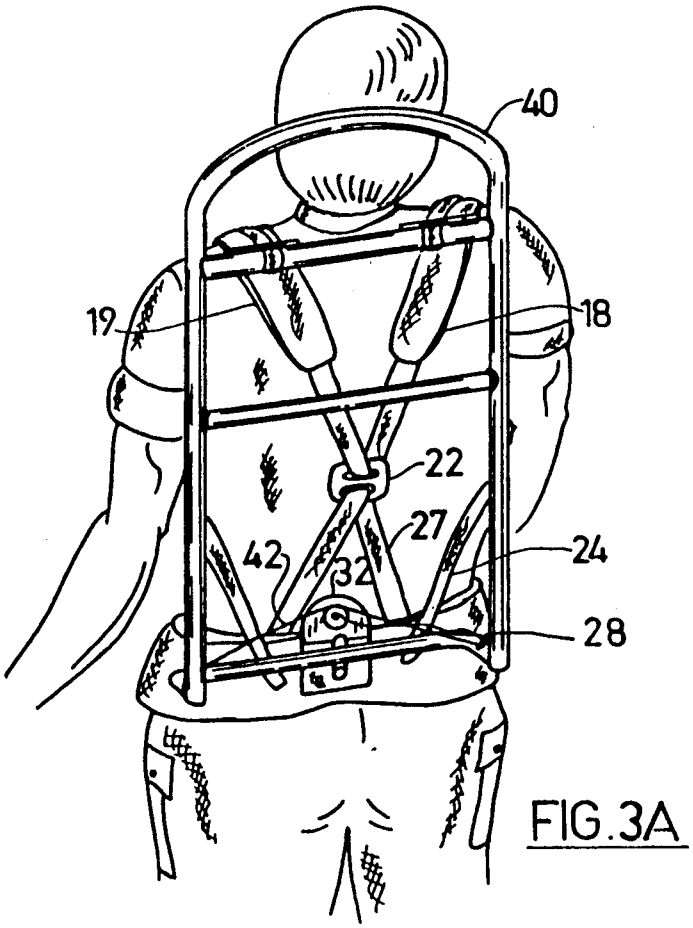

As seen in FIGS. 3A and 3B, backpack support wire 42 rests on, and is frictionally engaged with wire support roller 28 which is rotatably mounted to plate 32. Thus, frame 40 can slide from side to side relative to hip belt 12 with minimal friction. It is a particular feature of the embodiment of FIGS. 3A, 3B, 4A, 4B, 5A and 5B that by controlling the length of wire 42, the vertical orientation of frame 40 relative to hip belt 12 may be controlled. FIG. 3A illustrates a case wherein the wire 42 is relatively long and thus the frame 40 lies relatively low with respect to the hip belt. FIG. 3B illustrates a case wherein the wire 42 is relatively short and thus the frame 40 lies relatively high with respect to the hip belt.

It is an additional particular feature of the invention that the wire and roller mounting provides apparatus for connecting the central body mounting assembly to the shoulder mounting assembly which permits relative motion therebetween in three dimensions.

Figure 5B:
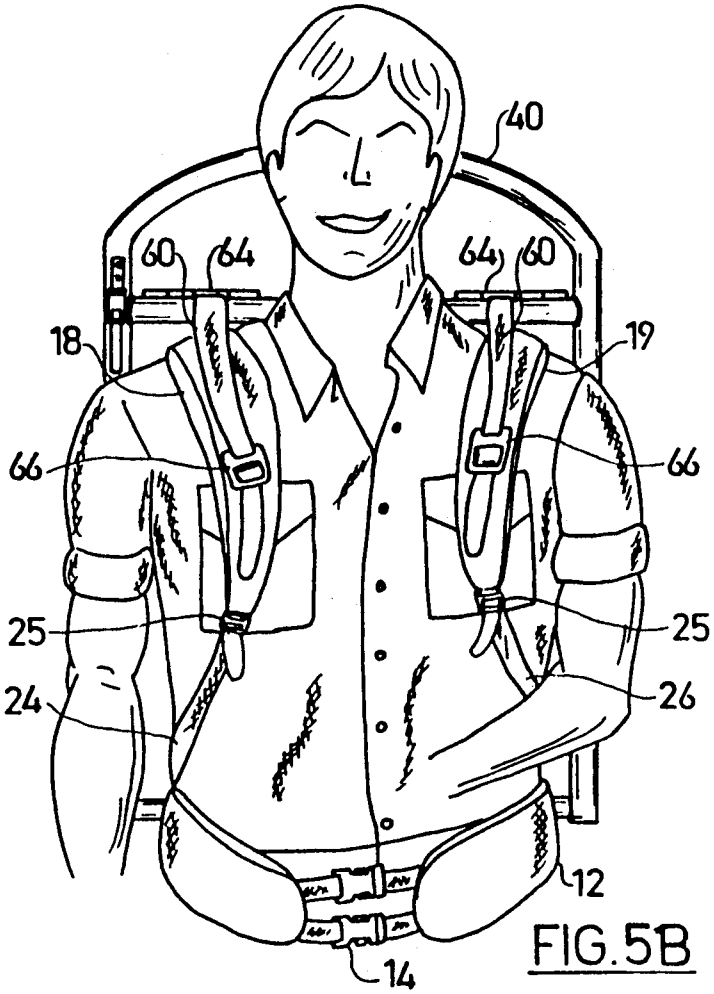
FIGS. 5A and 5B are pictorial illustrations showing the adjustment of the backpack support of FIGS. 3A and 3B.
Figure 5A:
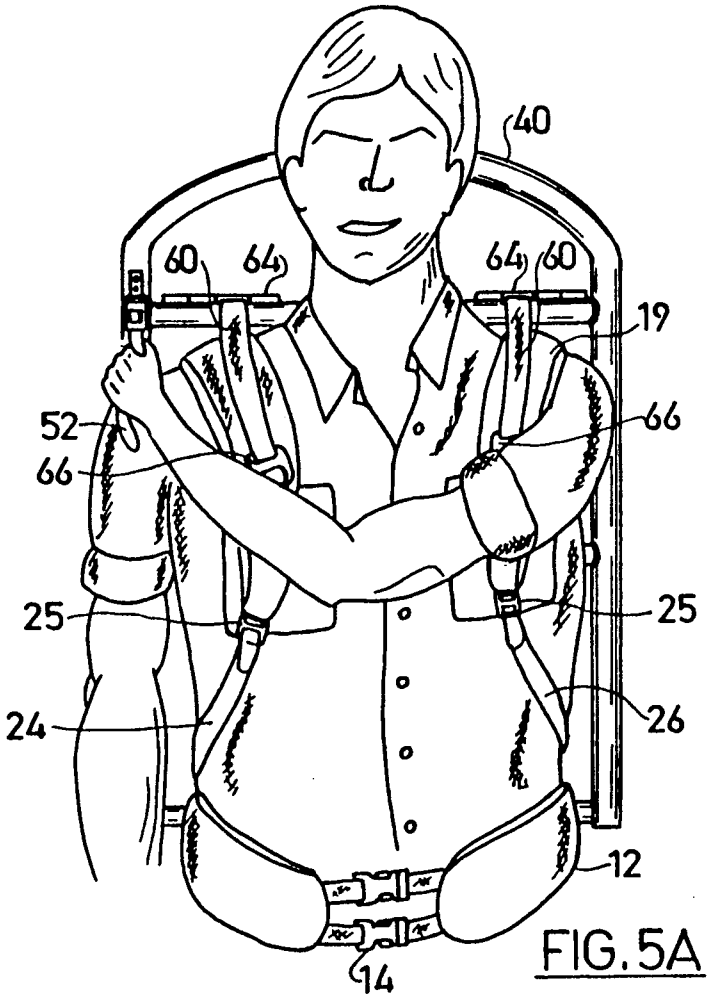

Reference is now made to FIGS. 5A and 5B which illustrate the opposite side of the backpack support from that illustrated in FIGS. 3A and 3B. Here it is seen that straps 60, one end of each of which is mounted at a selectable lateral position on frame 40 at a mounting location 64, are attached by means of a suitable buckle 66 onto respective shoulder pads 18 and 19, for holding the backpack frame against the user's back.

Figure 6:
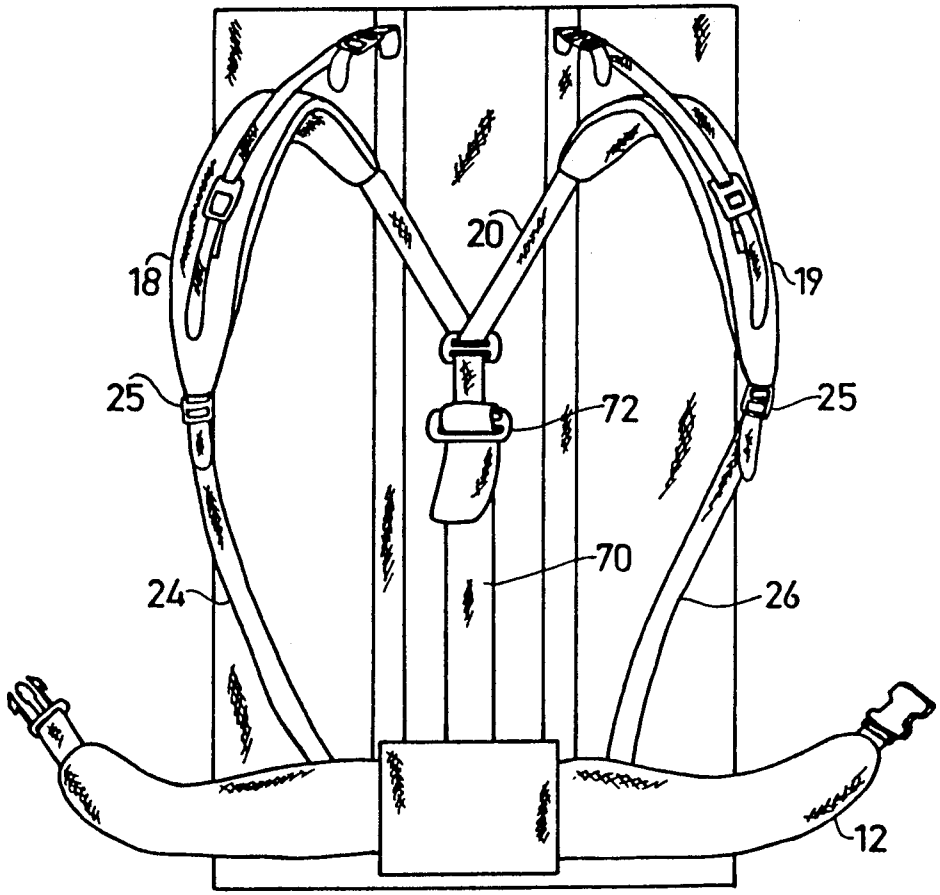
FIG. 6 is a pictorial illustration of an alternative embodiment of backpack support constructed and operative in accordance with a preferred embodiment of the invention.

FIG. 5A shows the user adjusting the length of wire 42 by pulling on strap 52. It is a particular feature of the present invention that this adjustment can be carried out by the user without removing the backpack frame from his back Reference is now made to FIG. 6, which illustrates an alternative embodiment of backpack support. Here the shoulder support assembly 16 is attached to the hip belt 12 by means of a resilient strap 70 which engages a buckle 72. The provision of resilient strap 70 is operative for generally maintaining a desired distribution of a load on the load support between the central body mounting assembly and the shoulder mounting assembly notwithstanding changes in the relative orientations thereof.

Figure 7:
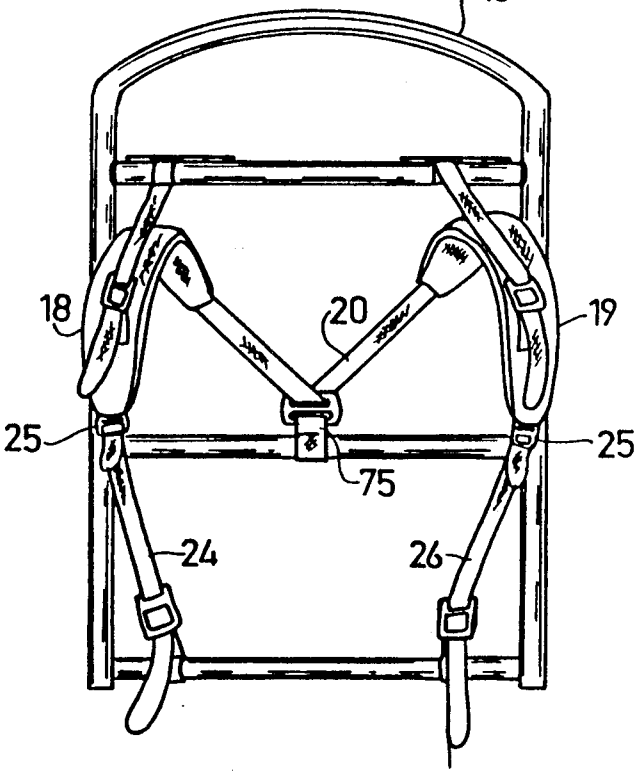
FIG. 7 is a pictorial illustration of a further alternative embodiment of backpack support constructed and operative in accordance with a preferred embodiment of the invention.

Reference is now made to FIG. 7, which illustrates a further alternative embodiment of the invention wherein the hip belt 12 is eliminated and the shoulder support assembly 16 is mounted directly onto the backpack frame 40 by means of a resilient strap 75.

It will be appreciated that any of the straps 20, 75 and 26 in any of the embodiments of the invention described above may be formed of resilient material for generally maintaining a desired distribution of a load on the load support between the central body mounting assembly and the shoulder mounting assembly notwithstanding changes in the relative orientations thereof.

It will be appreciated by persons skilled in the art that the present invention is not limited by what has been particularly shown and described hereinabove. Rather the scope of the present invention is defined only by the claims which follow:

We claim:

1. A backpack load support assembly comprising:

a central body mounting assembly in the form of a hip belt arranged to be supported on a user's hips;

a shoulder mounting assembly associated with the central body mounting assembly; and a load support member supported on the central body mounting assembly and on the shoulder mounting assembly;

said shoulder mounting assembly comprising:

first and second shoulder engagement elements which are arranged to be supported by first and second shoulders of a user, the first and second shoulder engagement elements being interconnected such that orientation of a first shoulder of the user higher than his second shoulder produces a corresponding orientation of the first and second shoulder engagement elements, thus maintaining a desired load distribution between the two shoulders independent of the relative orientation thereof; and strap means slidably connected to said first and second shoulder engagement elements and connected to said central body mounting assembly, at least one of the first and second shoulder engagement elements and said strap means being formed of a stretchable resilient material in order to permit stretching of the load support so as to accommodate variations in the distance between the shoulders and the waist depending on the body orientation of the user.

2. A load support according to claim 1 and wherein said first and second shoulder engagement elements are slidably connected to said strap means by a buckle at a location intermediate said first and second shoulder engagement elements.

3. A load support according to claim 1 and also comprising user operable means for determining the the vertical orientation of the load support member relative to the central body mounting assembly when the load support assembly is mounted on the user, said user operated means comprising an elongate wire member of selectable length, mounted on the load support member, which wire member slidably engages said central body mounting assembly, the length of the wire determining the vertical orientation of the load support member relative to the central body mounting assembly and the slidable engagement of the wire member with the central body mounting assembly enabling side-to-side motion of the load support member relative to the central body mounting assembly.

4. A load support comprising:

a central body mounting assembly;

a shoulder mounting assembly;

a load support member supported on the central body mounting assembly and on the shoulder mounting assembly; and stretchable resilient means interconnecting the shoulder mounting assembly and the central body mounting assembly in order to accommodate variations in the distance between the shoulders and the waist depending on the body orientation of the user for generally maintaining a desired distribution of a load on the load support member between the central body mounting assembly and the shoulder mounting assembly notwithstanding changes in the relative orientations thereof.

5. A load support according to claim 4 and also comprising user operable means for determining the vertical orientation of the load support member relative to the central body mounting assembly when the load support assembly is mounted on the user, said user operated means comprising an elongate wire member of selectable length, mounted on the load support member, which wire member slidably engages said central body mounting assembly, the length of the wire determining the vertical orientation of the load support member relative to the central body mounting assembly and the slidable engagement of the wire member with the central body mounting assembly enabling side-to-side motion of the load support member relative to the central body mounting assembly.

6. A load support comprising:

a central body mounting assembly;

a shoulder mounting assembly including first and second shoulder engagement elements which are arranged to be supported by first and second shoulders of a user;

a load support member supported on the central body mounting assembly and on the shoulder mounting assembly; and stretchable resilient means interconnecting the shoulder mounting assembly and the central body mounting assembly in order to accommodate variations in the distance between the shoulders and the waist depending on the body orientation of the user.

* * * * *